United States Patent [19]

Glennie

[11] 3,942,637

[45] Mar. 9, 1976

[54] PACKAGE FOR ENDLESS BELTS

[75] Inventor: Brian L. Glennie, Hastings, Minn.

[73] Assignee: Minnesota Mining & Manufacturing Company, St. Paul, Minn.

[22] Filed: Apr. 28, 1975

[21] Appl. No.: 571,908

[52] U.S. Cl. ..... 206/389; 206/303; 206/408; 206/410

[51] Int. Cl.[2] ..... B65D 85/02; B65D 85/67

[58] Field of Search ..... 206/303, 307–308, 206/387, 389, 408, 410, 412

[56] References Cited

UNITED STATES PATENTS

| | | | |
|---|---|---|---|
| 785,822 | 3/1905 | Mitchem | 206/389 UX |
| 3,482,681 | 12/1969 | Nerwin et al. | 206/410 |
| 3,520,988 | 7/1970 | Ballock, Sr. | 206/389 X |
| 3,888,577 | 6/1975 | Meyer | 206/303 X |

*Primary Examiner*—William T. Dixson, Jr.
*Assistant Examiner*—Steven E. Lipman
*Attorney, Agent, or Firm*—Alexander, Sell, Steldt & DeLaHunt

[57] ABSTRACT

A package for endless belts to avoid kinking and cracking of the belts including a first core having an axial slot to receive axially within said core one end of a nest of belts. The belts are wound around said first core and a second core is disposed in the opposite end of the belts. A third core inserted in the nest of belts and disposed in the loop within the first core will further restrict kinking of the belts.

9 Claims, 4 Drawing Figures

PRIOR ART

PACKAGE FOR ENDLESS BELTS

BACKGROUND OF THE INVENTION

1. Field of the Invention

This invention relates to an improvement in packaging of endless belt material to restrict folding or kinking the belts during shipment.

2. Description of the Prior Art

Endless abrasive belts have been sold in nests of 3–5 belts for convenience of shipping and the nested belts tend to support each other and decrease the possible folding or creasing of the belt. Belt kinks or folding cause cracks or tears in the belts and are most prevalent in coarse grit abrasive cloth belts and fine grit abrasive cloth and paper belts. These conditions are deleterious to the life of the endless belt. It has therefore been necessary to devise means for packaging the nested belts to avoid the development of folds or creases in one or more of the belts in the nest. Referring to the drawing which accompanies this application there is indicated in FIG. 1 a package of belts called a single coil nest. This nest of five belts has a first core which may be 3 inches in inside diameter positioned in one end of the nest and the nest is folded around a larger core of approximately 5–7 and then the nest extends back around the first end, over the larger roller and a third core is placed in the other end of the nest. It is found that if a box enclosing a single coil nest is dropped, kinks can develop in the belt at the areas indicated by the arrow 7 because the core in the end adjacent that area will move upward in the belt.

FIG. 2 shows a package called a double coil nest. In the double coil nest 3–5 belts the ends are positioned adjacent each other and cores may be placed in these ends. The ends are then folded together into the interior of the rest of the nest. In this type of the coil the nest often develops cracks at the areas indicated by the arrows 11.

Because of the expense of large abrasive belts which may be 1 inch to 52 inches in width and which may be from 25 to 121½ inches long, it is very disturbing to have the same shortened in life because of a poor or impractical method of shipping such belts.

It has therefore been an area of research to develop a way of packaging the single or double-coil nest to permit the shipment of endless abrasive belts without the belts being damaged and their useful life shortened due to kinks or folds.

SUMMARY OF THE PRESENT INVENTION

The present invention provides a new form of packaging for endless belts which will protect the belts from developing kinks during shipment under the normal forces resulting from handling and dropping, etc. to which the belts are exposed.

The package of the present invention comprises a first large core having an axially extending slot formed in one sidewall with the walls forming the slot being positioned other than radially with respect to the center of the large core. One end or loop of the nest is inserted axially into the core with the belts being positioned in the slot to position said one end of the nest within the core. The remainder of the nest is then wrapped about the outer peripheral surface of the large core and the other or free end has a second core positioned therein and is placed at the end of the wound nest. An outer wrap is disposed about the nest of belts and suitable fastening means is utilized to hold the free end of the nest against the wound nest to secure the end of the nest. A third core may be placed within the end of the nest disposed within the large core.

DESCRIPTION OF THE DRAWINGS

As advised above in the description of the prior art.

DESCRIPTION OF THE PREFERRED EMBODIMENT

Figure 1:
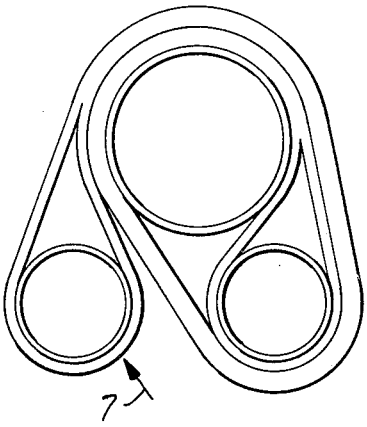
FIGS. 1 and 2 show the known single and double coil nest, respectively, utilized for shipping endless belts.
Figure 2:
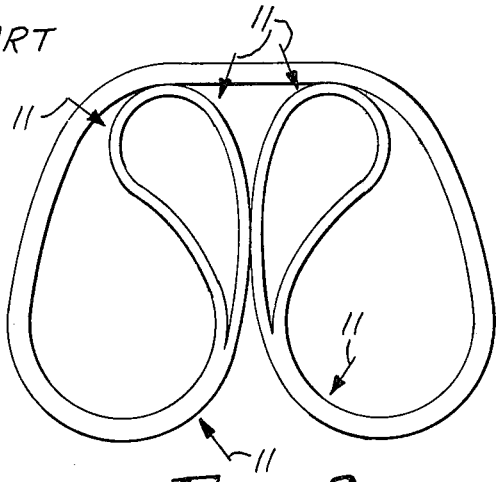
Figure 3:
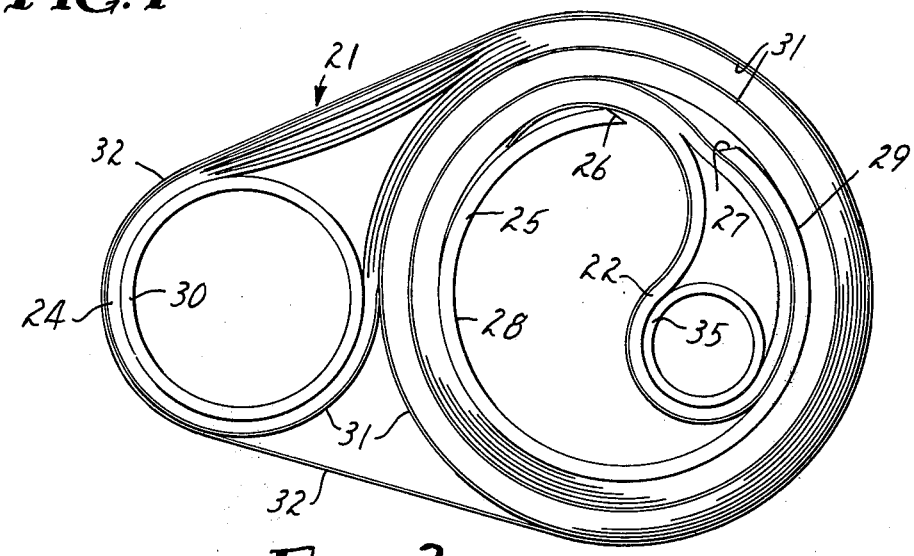
FIG. 3 is an end view of a nest of belts wound for packaging in accordance with the present invention.
Figure 4:
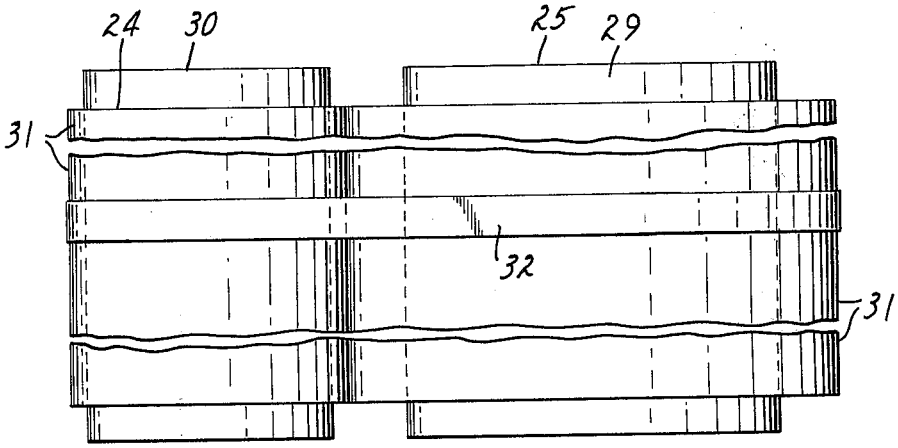
FIG. 4 is a plane view of the wound nest of belts of FIG. 3 illustrating portions thereof removed to permit the drawings to represent belts of any width.

Referring now to FIG. 3, there is illustrated a nest of abrasive belts which may comprise five belts each having a flexible backing supporting a layer of abrasive granules on one surface thereof. The belts are nested one within the other. These belts may be from one inch to 52 inchhes (2.54 cm to 132cm) in width and the belts may be 25 to 121½ inches (63.5 cm to 310 cm) in length. The total length of the abrasive material within one of the belts would thus be from 50 to 243 inches (127 cm to 618 cm).

The nest is generally illustrated by reference numeral 21 and has a first end 22 disposed within a large core 25. The core 25 may be 4 inches to 7 inches (10 cm to 18 cm) in inside diameter. The 7-inch diameter cores may be used if the belts of the nest 21 are of a coarse grade. A slot having a circumferential dimension of about 1 inch (2.5 cm) extends axially in the wall of the core 25. The edges of the slot are tapered with respect to the axis of the core such that the edge walls 26 and 27 forming the slot are disposed at an angle with respect to the radius of the core and preferably are shaped such that they taper from the inner cylindrical surface of the core toward the outer cylindrical surface of the core and the walls 26 and 27 diverge from each other from the inner 28 toward the outer peripheral surface 29. The core 25 is longer than the width of the belt to provide an additional one-half inch of length of additional core at each side of the belt.

The package is formed by placing the belts in the nest 21. Then one end of the nest 21 is positioned in axial alignment with the interior of the core 25 and the core is moved axially with a portion of the nest aligned with the slot formed by walls 26 and 27. The core and the nest are then assembled and after the end 22 is inserted within the core, the nest is convolutely wound about the outer peripheral surface 29 of the core 25. The free end 24 of the nest has a second core 30 disposed therein. The core 30 is no smaller than 2 inches (5 cm) in outside diameter and is possibly between 2 and 4 inches (5 and 11 cm) in outside diameter. This core is inserted into the free end and supports the free end 24. A wrapping 31 of, e.g., kraft paper is wound about the outer periphery of the nest 21 and a fastening member 32 is positioned around the wrapping and secures the free end 24 to the outer convolution on the core 25 to permit or prevent the unwinding of the nest.

In the illustrated embodiment, a third core 35 is disposed within the first end 22 of the nest 21 which end is disposed within the core 25. This core would have an outside diameter of between 1½ to 3 inches (3.8 to 8 cm).

The fastening member 32 may be a band or strap secured at its ends or a length of pressure-sensitive adhesive taper adhesively affixed to the wrapping 31 and extending entirely around the package or between the wrapping on the end 24 of the nest 21 and the portion of the nest 21 extending about the core 25.

The cores may be formed of pasteboard as is common with cores for winding material and have a wall thickness of between one eighth to one half inch (3mm and 12.7 mm). The cores are at least as long as the width of the belts preferably at least 1 inch (2.5 cm) longer with the core extending axially from each end of the nest of belts.

The cores and wound nest of belts is then placed in a rectangular packing carton to form the final package. The carton, not shown, would have suitable dimensions and be generally rectangular to enclose the portion of the package illustrated.

Having thus described the present invention, what is claimed is:

1. A package for endless belt, said package comprising a first hollow core having a slot extending axially in the wall thereof, a plurality of endless belts of the same length nested within each other and having one looped end of the nest of belts disposed within said first core with the remainder of the nest extending from said core through said slot and being wrapped around the outer peripheral surface of said first core, a second core disposed within the other end of said belts and contacting said other end, and means holding said other end to said wrapped portion of said belts on said first core.

2. A package according to claim 1 wherein a third core is disposed within said one looped end of the belts and disposed within said first core.

3. A package according to claim 1 wherein said belts are abrasives belts and wherein said holding means includes an outer wrapping around the exterior of said nest of belts and cores.

4. A package according to claim 1 wherein said first core has an inside diameter of 4 to 7 inches.

5. A package according to claim 1 wherein said first core has an inside diameter of 4 to 7 inches and said slot is defined by walls in the core which are angularly disposed relative to the radius of said core and diverge from each other between the inner surface and said outer peripheral surface.

6. A package according to claim 1 wherein said cores have a length exceeding the width of the nest by at least 1 inch.

7. A package according to claim 1 wherein said first core has an inside diameter of 4 to 7 inches, said slot is defined by walls in the core which are angularly disposed realtive to the radius of said core and diverge from each other between the inner surface and said outer peripheral surface to define a slot about 1 inch wide, and said second core has an outside diameter of between 2 and 4 inches.

8. A package according to claim 7 wherein a third core is disposed with said one looped end of the nest disposed in said first core.

9. A package according to claim 8 wherein said third core has an outside diameter of between 1 ½ and 3 inches.

* * * * *